United States Patent [19]

Bilsbury

[11] Patent Number: 4,773,329

[45] Date of Patent: Sep. 27, 1988

[54] COMPOSITE SHOT WAD STRUCTURE FOR STEEL AND OTHER HARD SHOT

[75] Inventor: Stephen J Bilsbury, Godfrey, Ill.

[73] Assignee: Olin Corporation, Stamford, Conn.

[21] Appl. No.: 4,651

[22] Filed: Jan. 20, 1987

Related U.S. Application Data

[63] Continuation-in-part of Ser. No. 801,678, Nov. 25, 1985, abandoned.

[51] Int. Cl.[4] ..... F42B 7/08

[52] U.S. Cl. ..... 102/451

[58] Field of Search ..... 102/448-463, 102/532

[56] References Cited

U.S. PATENT DOCUMENTS

| | | | |
|---|---|---|---|
| 1,243,155 | 10/1977 | Gerhardt | 102/449 |
| 1,297,216 | 3/1919 | Matteus | 102/449 |
| 3,208,382 | 9/1965 | Foote et al. | 102/453 |
| 3,420,178 | 1/1969 | Rempel | 102/453 |
| 3,516,360 | 6/1970 | Lathrope et al. | 102/451 |
| 3,598,057 | 8/1971 | Potter | 102/460 X |
| 3,721,194 | 3/1973 | Weston, Jr. | 102/449 |
| 3,741,122 | 6/1973 | Kordas, Jr. | 102/450 |
| 3,788,224 | 1/1974 | Merritt | 102/450 |
| 3,935,816 | 2/1976 | Boquette, Jr. | 102/466 |
| 4,220,090 | 9/1980 | Fackler | 102/449 |
| 4,569,288 | 2/1986 | Grelle et al. | 102/466 |
| 4,627,356 | 12/1986 | Buczkowski | 102/453 |

FOREIGN PATENT DOCUMENTS

| | | | |
|---|---|---|---|
| 97567 | of 1887 | United Kingdom | 102/449 |

*Primary Examiner*—Harold J. Tudor

*Attorney, Agent, or Firm*—Bruce E. Burdick

[57] ABSTRACT

An improved composite wad structure has a unique laminated shot pocket portion. The wad structure is useful in a shotshell with hard shot pellets, such as steel or tungsten shot, having a hardness generally at least equal to that of the barrel of a gun in which the shotshell is to be fired. The laminated shot pocket portion includes a thin-walled, cup-shaped inner liner for supporting a column of the hard shot and thick-walled, cup-shaped outer tubular body encompassing the inner liner. The inner liner is formed of a tough, high tensile strength material capable of withstanding compressive forces generated by acceleration of the hard shot, when the shotshell containing the wad structure is fired in the barrel of the gun, so as to protect the gun barrel from being scored by the hard shot. The outer body is formed of a soft, low tensile strength material capable of expanding to obturate the combustion gases produced in the gun barrel when the shotshell is fired. The inner liner is nested in and moded to the outer body.

1 Claim, 1 Drawing Sheet

COMPOSITE SHOT WAD STRUCTURE FOR STEEL AND OTHER HARD SHOT

RELATED APPLICATION

This application is a continuation-in-part of a copending U.S. patent application Ser. No. 801,678, filed Nov. 25, 1985, now abandoned.

BACKGROUND OF THE INVENTION

1. Field of the Invention

The present invention generally relates to shot-shells and, more particularly, is concerned with an improved composite shot wad structure for a shotshell having a unique laminated shot pocket portion adapted for used with hard shot, such as steel or tungsten shot. 2. Description of the Prior Art "Lightweight" as used herein means substantially lighter than lead (i.e. lighter than 11 gm/cc density).

"Deformation resistant" as used herein means having an ultimate tensile strength greater than 4000 psi.

It is conventional practice to provide plastic wad structures for use in shotshells to house the shot charge, obturate combustion gases, and cushion the shot charge when the loaded wad is fired from a shotgun. One wad structure representative of this practice is illustrated and described in U.S. Pat. No. 3,285,174 to V. C. Moehlman et al., which patent issued Nov. 15, 1966 and is assigned to the assignee of the present invention.

Typically, the was structure has a unitary one-piece construction and is composed of a shot pocket portion, a filler or cushioning portion and an obturating portion. The shot pocket portion is shaped like a cup and includes a cylindrical split side wall open at the top and closed at the bottom. The obturating portion has a shallow cup-like shape and includes a base with a peripheral flared skirt. The cushioning portion generally includes a series of flexible members which extend between and interconnect the other two portions of the wad structure.

When a shotshell containing the above-described wad structure is loaded in a shotgun and fired, a propellant disposed in the shell tube rearwardly of the obturating portion is consumed and produces high pressure combustion gases. The pressurized gases act upon the obturating portion, causing its skirt to expand outwardly into sealing relationship with the inner surface of the shell tube and wall of the gun barrel bore. Such sealing increases the compressive forces being generated by the pressurized combustion gases. Since the column of shot pellets contained in the shot pocket portion of the wad structure initially resists forward movement, the compressive forces first compress the cushioning portion of the wad structure. Then, as the wad structure and shot column are propelled out of the shell tube and start to accelerate through the gun barrel, the shot column pushes radially outward toward the wall of the barrel bore and against the sidewall of the shot pocket portion.

There have, in the past, been a number of attempts made to vary or modify such a wad design like that of the Moehlman et al. U.S. Pat. No. 3,285,174 in order to decrease the dispersion of the shot by adding additional components, such as a closed pouch to hold the shot for longer than normal (e.g. Lathrop et al.'s U.S. Pat. No. 3,516,360 issued June 23, 1970) or a heavy deformable lead liner to entrain the shot (e.g. British Pat. No. 9756). However, these have limited utility, the shotgun hunter normally desires a certain amount of dispersion, as otherwise he would use a rifle with a single bullet, so such dispersion decreasers are often counter-productive in that they decrease the velocity of the shot by adding parasitic weight. Maximum velocity is usually desired to minimize the required "lead angles" when shooting moving targets (e.g. waterfowl or upland game).

Historically, shot pellets have been composed of lead which is much softer than the metal traditionally composing the gun barrel. Therefore, an important objective of the shot pocket portion of the wad structure heretofore has been to prevent contact of the softer shot pellets with the harder barrel in order to prevent leading of the barrel and distortion of the shot pellets. This objective of lead shot protection has been satisfactorily attained by the shot pocket portion design disclosed in the aforesaid patent.

However, due to the toxicity of lead and health concerns about possible retention of lead shot in game intended for human consumption, laws have recently been enacted in may states which substantially limit or even ban the use of traditional lead shot pellets in hunting game and mandate the use of hard materials having little or no known toxicity, such as steel. In military shotguns, the recently developed Olin shotshells use extremely hard shot (for armor penetration) such as tungsten. While formerly in the case of lead shot pellets, the objective of the shot pocket portion was to protect the softer shot pellets from deformation by the harder gun barrel, now in the case of steel or tungsten shot pellets, the new objective is to protect the softer gun barrel from the harder shot pellets.

The shot pocket portions of wad structures designed for use with lead shot pellets have proven unable to meet this new objective. The plastic materials used heretofore fail to withstand the compressive forces of the hard shot. The shot readily penetrates through the sidewall of the pocket portion and contact the barrel wall, causing marring or scoring thereof. Merely making the plastic material heavier or thicker or substituting a stronger plastic material has not been found to provide workable and economical solution to the problem of preventing barrel scoring. Plastic materials that are strong enough to withstand the force of the steel shot are usually expensive and, in some cases, too stiff to allow proper obturation of the propellant gases in cold weather.

This new objective appears to require the use of a plastic material that has two entirely different sets of properties—high tensile strength for barrel protection and high ductility for proper obturation. Seemingly, one way around this requirement would be to design a two-piece wad, the top of which is hard, tough plastic material and the bottom of which is a soft plastic material which obturates easily. A two-piece plastic wad is, however, expensive in that it requires two separate molding operations and an assembly operation. The cost of these requirement would be prohibitive in terms of producing a competitively priced shotshell.

Consequently, a need exists to come up with a solution which will provide the two different properties mentioned above, but will be workable and economical in the sense that it takes advantage of conventional mass-production fabrication techniques.

SUMMARY OF THE INVENTION

The present invention provides an improved composite shot wad structure designed to satisfy the aforementioned needs. The improved wad structure of the invention incorporate a unique laminated pocket portion having an inner liner of tough, high tensile strength material, such as nylon, and an outer body of soft, low tensile strength material, such a polyethylene, which also composes the remainder of the wad structure.

This unique pocket portion construction satisfies the aforementioned requirement for a material exhibiting the dual properties of high tensile strength for barrel protection and high ductility for proper obturation. On the one hand, the tough, high tensile strength inner liner adapts the pocket portion of the improved wad structure to withstand the radially-directed compressive forces generated by acceleration of hard shot, such as steel or tungsten shot, in the barrel of a shotgun. The hard shot is prevented form penetrating the pocket portion sidewall and coming in contact with and marring the shotgun barrel. On the other hand, the soft, low tensile strength outer body adapts the structure to obturate effectively.

Thus, the invention provides a solution which protects the shotgun barrel without sacrificing obturation capacity. In addition, the solution is indeed workable and economical in that known commercially-available materials and conventional fabrication techniques, such as two-stage injection molding or insert molding processes, can be used to produce the improved wad structure on a mass-production basis.

Accordingly, the present invention is set forth in an improved composite wad structure for use in a shotshell with hard shot pellets having a hardness generally at least equal to that of the barrel of a gun in which the shotshell is to be fired. The invention relates to a laminated shot pocket portion of the wad structure which comprises: (a) an inner liner for supporting a column of the hard shot, the liner being formed of a tough, high tensile strength material capable of withstanding compressive forces generated by acceleration of the hard shot, when the shotshell containing the wad structure is fired in the barrel of the gun, so as to protect the gun barrel from being scored by the hard shot; and (b) an outer body encompassing the inner liner and being formed of a soft, low tensile strength material capable of obturating the combustion gases produced in the gun barrel when the shotshell is fired.

More particularly, the outer body and inner liner are connected together to form a one-piece construction. Preferably, the body and liner are molded together. Also, the inner liner and outer body are each cup-shaped with the inner liner being nested in the outer body. Further, the inner liner and outer body each have an endless sidewall with the inner liner sidewall being thinner than the outer body sidewall. In one exemplary form, the high tensile strength material of the inner liner is nylon, whereas the low tensile strength material of the outer body is polyethylene.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
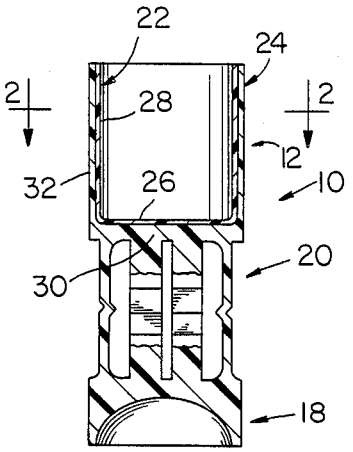
FIG. 1 is an enlarged elevational view, in section, of an improved wad structure having the unique laminated shot pocket portion of the present invention.

Referring now to the drawings, and particularly to FIG. 1, there is shown an improved composite wad structure, generally designated by the numeral 10, which has a unique laminated shot pocket portion 12 constructed in accordance with the present invention. Although useful with softer shot, the improved wad structure 10 is particularly useful in a shotshell 14 with hard shot pellets 16, such as ones made of steel, tungsten or other hard material having a hardness generally at least equal to that of the barrel of the gun in which the shotshell is to be fired.

In addition to the laminated shot pocket portion 12 of the present invention, the wad structure 10 generally includes a obturating portion 18. It also can include a cushioning portion 20, although, depending on the size of the shot load desired in the shell 14, the cushioning portion can be omitted. While the obturating and cushioning portions 18,20 of the wad structure shown in FIGS. 1 and 3 have constructions substantially identical to those illustrated in the patent cited earlies, other constructions can be used. Also, as mentioned, the cushioning portion 20 can be eliminated altogether. Since these portions are conventionally known and do not form any part of the present invention, they need not and will not be described in detail herein. Instead, for more information concerning the detailed construction and function of these portions, attention is directed to the referenced patent.

Figure 2:
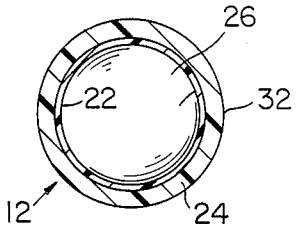
FIG. 2 is an enlarged sectional view of the laminated shot pocket portion of the wad structure taken along line 2—2 of FIG. 1.

As seen clearly in FIGS. 1 and 2, the laminated shot pocket portion 12 of the wad structure 10 basically includes an inner liner 22 and a tubular outer body 24. The inner liner 22 is generally cup-shaped for supporting a column of the hard shot 16. The outer body 24 is also cup-shaped for encompassing and containing the inner liner 22 in a nesting relationship. The inner liner 22 and outer body 24 are preferably fabricated using conventional dual injection molding processes wherein the bottom wall 26 and endless sidewall 28 of the inner liner 22 are formed generally coextensive with and bonded to the bottom wall 30 and endless sidewall 32 of the outer body so as to produce a one-piece construction.

Although the sidewall 28 of the inner liner 22 is substantially thinner than the sidewall 32 of the outer body 24, as can be seen in FIG. 2, the inner liner 22 is capable of withstanding high compressive forces due to the tough, high tensile strength material of which it is formed compared to the soft, low tensile strength material forming the outer body 24. For example, the inner liner 22 can be formed of materials, such a glass filled nylon, metal foil, or other deformation resistant materials, which are capable of withstanding the radially-directed compressive forces generated by acceleration of the hard shot 16, when the shotshell 14 containing the wad structure 10 is fired in the barrel of the gun. By doing so, the inner liner 22 resists penetration or puncture by the hard shot 16 and thereby protects the gun barrel from being scored by the hard shot.

As mentioned above, in contract to the inner liner 22, the outer body 24 is formed of a soft, low tensile strength material, such a polyethylene, which is capable of expanding radially to obturate the combustion gases produced in the gun barrel when the shotshell 14 is fired. The remainder of the wad structure 10 is composed of the same soft material as composes the outer body 24 of the pocket portion 12.

Figure 3:
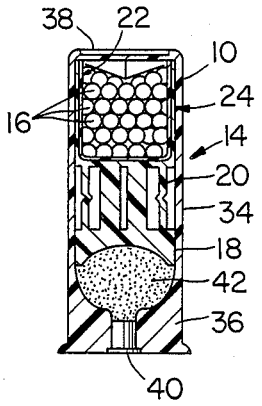
FIG. 3 is an elevational view, in section, of a shotshell containing the improved composite wad structure of FIG. 1.

The improved wad structure 10 is shown installed in a conventional manner as part of the loaded shotshell 14 in FIG. 3. The cylindrical casing 34 of the shell 14 encompasses the wad structure. The shell 14 includes a base 36 at one end of the casing 34 and an infolded end closure 38 at the other end. A primer 40 is positioned in the base 36 and is operative upon being struck by a firing pin to ignite a propellant charge 42 inside the casing 34. The composite wad 10 is positioned in the casing 34 with its obturating portion 18 adjacent the propellant charge 42. The column of shot 16 is positioned inside the inner liner 22 of the pocket portion 12, which in the illustrated embodiment, is separated from but integrally connected with the obturating portion 18 by the cushioning portion 20.

Upon firing the propellant charge 42, explosive gases act upon the obturating portion 18 causing it to flare outwardly against the casing 34 forming an effective gas seal. The propellant forces are transmitted from the obturating portion 18 through the cushioning portion 20 to the column of shot 16 positioned in the pocket portion 12. As the wad structure 10 and shot column leave the shell 14 and travel down the barrel of the gun, the shot 16 bulges outwardly against the barrel, but the barrel is shielded or protected from marring or scoring from contact with the hard shot 16 by the inner liner 12 of the pocket portion 12. Also, the presence of the soft material of th outer body 24 outside of the bulging inner liner 22 increases the effectiveness of the sealing between the shot wad structure 10 and the barrel.

It is thought that the improved composite shot wad structure of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. In an improved all plastic composite wad structure for use in a shotshell with steel shot pellets, a laminated shot pocket portion comprising:

(a) a lightweight cup-shaped inner liner of a thickness no greater than the diameter of the steel shot pellets with which it is intended to be used for supporting the load of steel shot, said liner being formed of a deformation resistant material having sufficient hardness to withstand radially-directed compressive forces generated by acceleration of the shot, when the shotshell containing said wad structure is fired in the barrel of the gun, so as to prevent the steel shot from pressing through the liner and so as to thereby protect the gun barrel from being scored by the hard shot; and (b) an outer body having a cup shaped portion having cup walls of a thickness no greater than the diameter of the steel shot pellets with which it is intended to be used and conforming in shape to the cup-shaped inner liner encompassing said inner liner and being formed of a plastic material being sufficiently soft and pliable to obturate the space between the cup shaped inner liner and a surrounding barrel to prevent leakage forwardly past the shot container of the combustion gases produced in the gun barrel when the shotshell is fired, the inner liner having a height at least equal to the maximum height of the expected load of steel shot expected to be contained in the shot container, the inner liner further having a completely open front so as to not restrict the steel shot from passing forwardly from the shot container following launch from a shotgun barrel.

* * * * *